US010449412B2

(12) United States Patent
Zhu

(10) Patent No.: US 10,449,412 B2
(45) Date of Patent: Oct. 22, 2019

(54) LOW NOISE DIRECT DRIVE TREADMILL

(71) Applicant: ZHE JIANG FENG SHANG TECHONOLOGY CO., LTD., Hangzhou (CN)

(72) Inventor: Zhengyuan Zhu, Hangzhou (CN)

(73) Assignee: ZHE JIANG FENG SHANG TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 15/551,023

(22) PCT Filed: Apr. 12, 2016

(86) PCT No.: PCT/CN2016/079100
§ 371 (c)(1),
(2) Date: Aug. 14, 2017

(87) PCT Pub. No.: WO2016/127957
PCT Pub. Date: Aug. 18, 2016

(65) Prior Publication Data

US 2018/0056119 A1 Mar. 1, 2018

(51) Int. Cl.
*A63B 22/02* (2006.01)
*A63B 71/06* (2006.01)

(52) U.S. Cl.
CPC ..... *A63B 22/0235* (2013.01); *A63B 22/0207* (2015.10); *A63B 22/0214* (2015.10); *A63B 71/0622* (2013.01); *A63B 2071/0658* (2013.01)

(58) Field of Classification Search
None
See application file for complete search history.

(56) References Cited

U.S. PATENT DOCUMENTS 5,674,453 A * 10/1997 Watterson ..... A63B 22/0012 482/54
6,302,826 B1 * 10/2001 Lee ..... A63B 22/02 482/51

(Continued)

FOREIGN PATENT DOCUMENTS

CN 203790512 8/2014
CN 203954551 11/2014

(Continued)

OTHER PUBLICATIONS

International Search Report and Written Opinion, issued in the corresponding PCT application No. PCT/CN2016/079100, dated Jul. 15, 2016, 18 pages.

(Continued)

*Primary Examiner* — Stephen R Crow
(74) *Attorney, Agent, or Firm* — Hamre, Schumann, Mueller & Larson, P.C.

(57) ABSTRACT

The invention relates to the treadmill technology, and more particularly to the low noise type direct drive type treadmill. It has solved the technical problems such as large output power loss and large noise. The low noise type direct-drive type treadmill includes a running platform, an endless running belt arranged on the running platform, a rotating roller arranged at one end of the running platform and a tubular motor arranged at the other end. The rotary roller and tubular motor is arranged parallel to each other and provided with a running belt fixed to the running platform between the rotating roller and the tubular motor, the annular running belt is arranged between the rotating roller and the tubular motor and the annular running belt is located on the periphery of the running belt when the tubular motor is operable to drive the endless running belt.

11 Claims, 5 Drawing Sheets

(56) References Cited

U.S. PATENT DOCUMENTS

| | | | | |
|---|---|---|---|---|
| 6,455,960 | B1 | 9/2002 | Trago et al. | |
| 6,765,329 | B2 * | 7/2004 | Wolters | H02K 1/146 310/51 |
| 6,833,644 | B1 * | 12/2004 | Lee | H02K 23/62 310/91 |
| 6,879,078 | B2 * | 4/2005 | Wolters | H02K 1/146 310/216.074 |
| 7,337,524 | B2 * | 3/2008 | Wolters | H02K 1/146 29/596 |
| 7,362,016 | B2 * | 4/2008 | Cheng | A63B 22/02 310/52 |
| 9,937,375 | B2 * | 4/2018 | Zhu | A63B 71/0054 |
| 2003/0094867 | A1 * | 5/2003 | Wolters | H02K 1/146 310/64 |
| 2013/0035214 | A1 | 2/2013 | Wang | |
| 2017/0305676 | A1 * | 10/2017 | Ramezani | B65G 23/08 |
| 2018/0056119 | A1 * | 3/2018 | Zhu | A63B 22/0235 |

FOREIGN PATENT DOCUMENTS

| | | |
|---|---|---|
| CN | 104707297 | 6/2015 |
| CN | 204582412 | 8/2015 |

OTHER PUBLICATIONS

First Office Action, issued in the corresponding Chinese application No. CN201510075196.5, dated Jul. 6, 2016, 8 pages.

Notification to Grant Patent Right for Invention, issued in the corresponding Chinese application No. CN201510075196.5, dated Aug. 2, 2016, 4 pages.

* cited by examiner

LOW NOISE DIRECT DRIVE TREADMILL

TECHNOLOGY DOMAIN

This invention is directed to treadmill technology field, particularly related to low noise type direct drive style treadmill series.

TECH BACKGROUND

Treadmill is the most common facility in family fitness and gym. Easy to control makes treadmill the best option of family fitness.

Treadmill is mainly tied with the pivoted arm at the proper position of the armrest which enables the pivoted arm to stretch out the machine from anterior direction beneath the body. On the other side, pivot is fixed in the proper position of running frame.

Ground slide pulley is equipped at the bottom of the front end of the running frame. Pulley is designed to save physical power of the user, is steady for sustaining, and saves energy when the frame is folded.

At present, the general treadmill driven by running belt has such structure: the motor is connected to the roller by a belt drive structure.

Previous design somehow can meet the demands for utilize requirement, but defect still remains: when treadmill is activated, running belt exerts eminent noise which impairs excise mood. Second, the structure of the running belt drive causes large energy consummation in the aspect of power output which means treadmill has high energy exhaustion. Besides, it has high cost in manufacture, large size in volume. People proceed long time exploration in solving existing technology deficiencies and propose varies solution.

For instance, the Chinese patent document discloses a treadmill, [application number: 201420026381.6].

It comprises a base, the base has first roll and rear roll which separately installing at both ends of the base. Treadmill encircles the first roll and rear roll. On the base, two vertical support arm settings are near the side of first roll.

The support arm has an inverted U-shape bracket which was sliding mounted, bracket has two vertical-setting pillar and transverse-setting beam. Pillar is set at supporting arms with slip stalled on it. Locking mechanism is situated among the pillar and supporting arm. Beam has a display screen and bracket has two horizontal handrails which was parallel with each other, two handrails unanimously extend from first roller to rear roller direction.

One the first handrail, measuring instrument was installed to measure the blood pressure and heart rate of exercisers, instrument connects with display screen. For this scheme, it enables users know his/her own physical status and make proper adaptive adjustment accordingly. Scheme is wildly used in fitness.

The design in some extents changes the existing tech deficiency; however, the following flaws have not been eradicated:

Design was unreasonable, this scheme does not dissolve the problem mentioned above fundamentally, and operated with poor practicability.

BRIEF DESCRIPTION OF THE DRAWINGS

Picture 1 is a schematic structural view for invention.

Picture 2 is simplified structure of treadmill.

Figure 1:
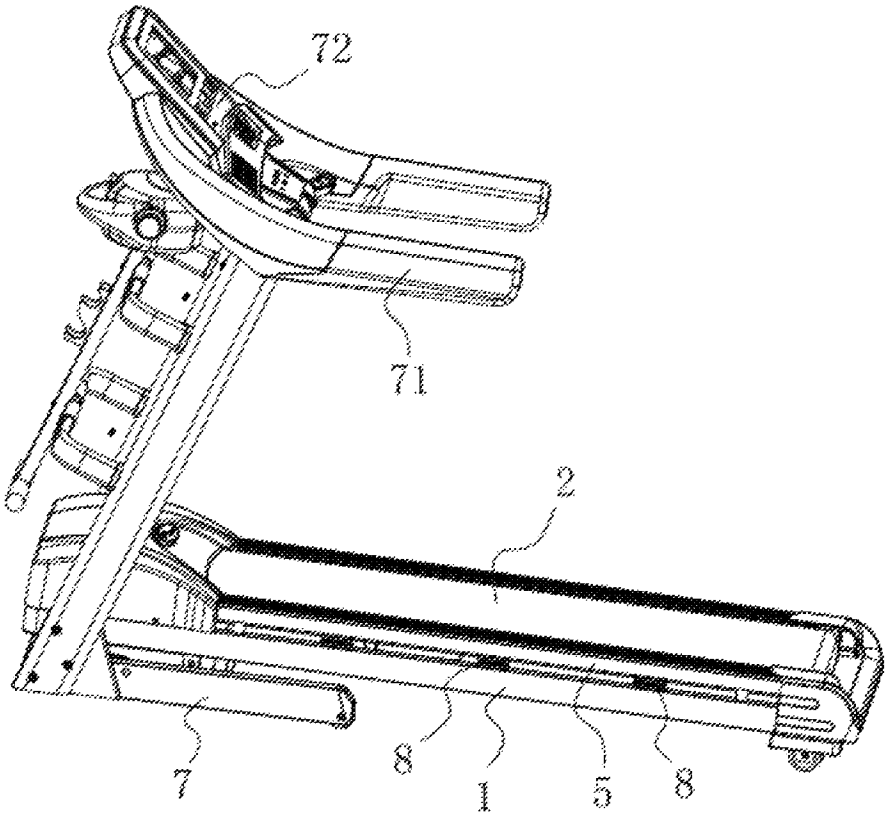
Figure 2:
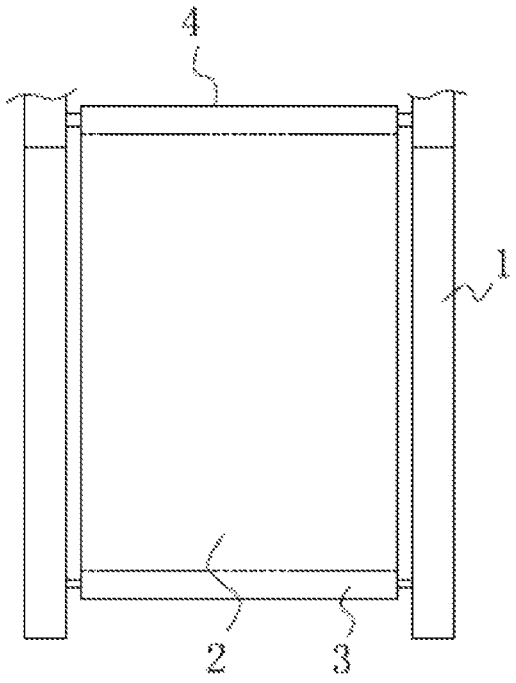
Figure 3:
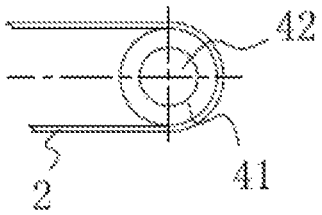
Figure 4:
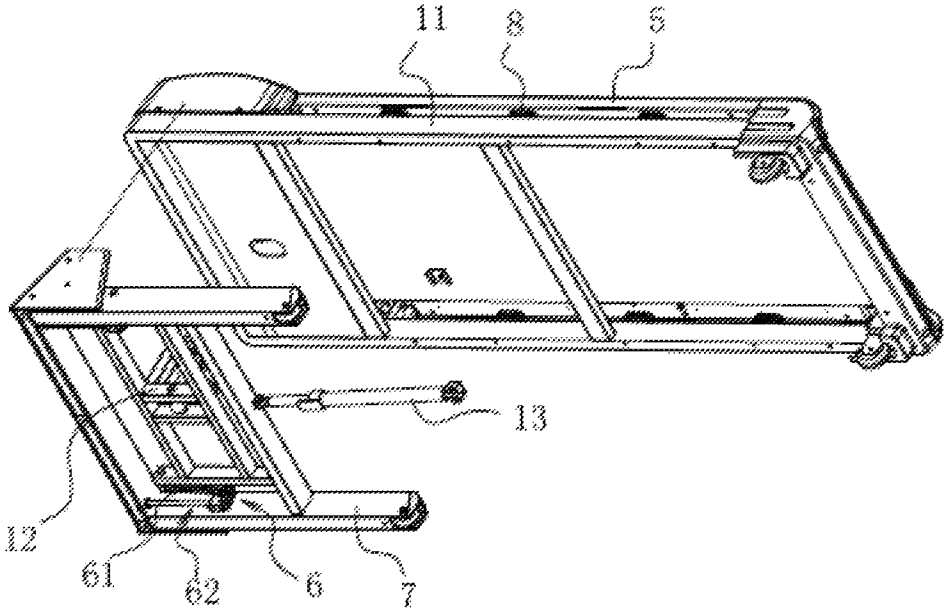
Figure 5:
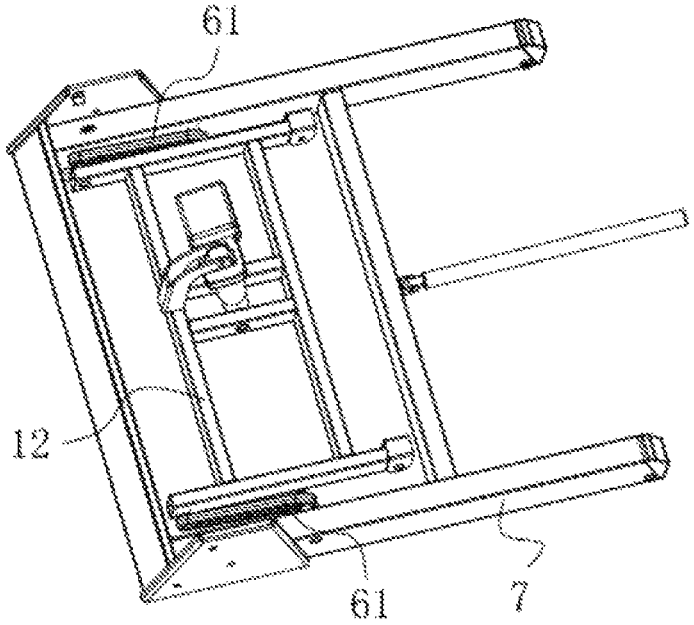
Figure 6:
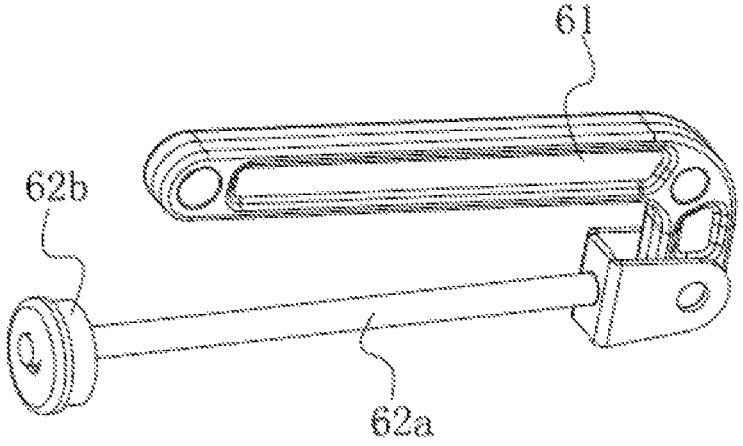
Figure 7:
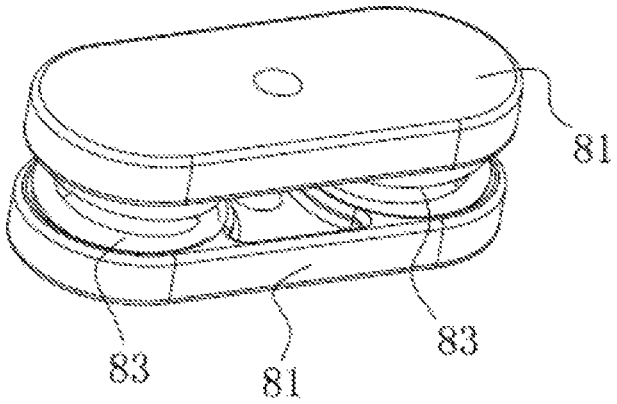
Figure 8:
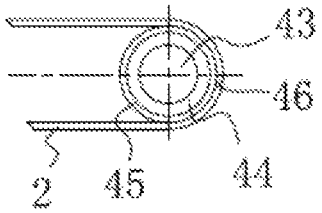

Picture 3 is outer rotor tubular motor coupled to loop treadmill belt.

Picture 4 is schematic diagram of the explosion structure after removing the handrail.

Picture 5 is the local structure of picture 4.

Picture 6 is the suspended damping structure.

Picture 7 is the diagram of elastic buffer Target.

Picture 8 is the practical structure of example 2.

CONTENTS OF INVENTION

The aim of the invention targeted on above mentioned issues is to provide a design for low noise type direct drive style treadmill which can deduct energy output and reduce noise.

To achieve this goal, following design is adopted in invention: the low noise type direct-drive style treadmill comprises a running platform, an encircled running belt is intertwined on the running platform, a roller is fixed at one end of the running platform and a tubular motor is fixed at the other end. Rotary roller as mentioned above is parallel to motor. Running belt plate installed between roller and tubular motor. Moreover, when tubular motor operates, it automatically rotates running belt which was surround periphery of the running belt plate.

In the present application, the structure of the loop treadmill belt set between the roller and the tubular motor does not only generate the power to tubular motor thus directly rotating loop treadmill belt as well as preventing energy loss but also reduces the energy consumption of operational use. Meanwhile it does not require belt drive structure, reduces noise and cost simultaneously, secondly, tubular motor can also shrink the space for whole machine.

The tubular in low noise type direct drive style treadmill motor is an outer rotor tubular motor including an outer rotor and an inner stator. The inner stator is connected to the treadmill stand, running belt encircle outer rotor. This structure is not only easy to install and manufacture, but also reduces the manufacturing cost.

The length of the outer rotor is longer than the width of the loop treadmill belt. The structure can ensure the stability and safety of the rotation of ring running belt.

As for another scheme, in the above treadmill, the tubular motor is an inner rotor tubular motor, it has the outer rotor and inner stator. The inner stator is connected to the treadmill stand, tubular piece is coupled to outer rotor which affix the periphery. Tubular gadgets links the outer rotor, and outer rotor can rotate the tubular gadgets. Loop treadmill belt circulates the tubular gadgets.

In the above treadmill, there should be at least one bearing installed between outer rotor and tubular gadgets.

This structure can further ensure the stability of rotating.

The length of the tubular gadgets is longer than the width of the loop treadmill belt. The structure can ensure the stability and safety of the rotation of loop treadmill belt.

Front end of treadmill stand suspends from the underframe through suspended damper structure. When the treadmill received downward force descending the front end, suspended structure could assist the rise of the front end.

Adapt such structure could reset front end of treadmill when treadmill received downward force, hence it improve the Damping effect.

In the above treadmill, suspended damper structure has two sets symmetrically fixed on the two sides of treadmill stand, every set of suspended damper structure contains at least one cantilever.

One side of the cantilever is hinged on the treadmill stand, the other side is coupled to the base frame by an elastic telescopic assembly.

The middle part of the cantilever is hinged on the base frame which ensures stability as well as consistency of two sides' bumper's performance. When treadmill receives downward pressure which sways the cantilever, cantilever will reset under the force of the elastic telescopic components, hence the treadmill will automatically rise.

In the above treadmill, the elastic telescopic assembly contains a conductive rod. One end of which is hinged to the cantilever and the other end across the chassis fixed at the elastic barrier against the base frame.

The cantilever's sway leads the conductive rod moving in reciprocate way, and the elastic barrier prevents the conductive rod from divorced from the chassis.

In the above treadmill, the cantilever is L-shaped and the edge is hinged to the chassis, and the length of one end of the cantilever which connects the treadmill stand is larger than one side joint the elastic telescopic assembly. With this structure, the moment at which the cantilever is connected to the treadmill stand is greater than the other end, which makes it easier to swing the cantilever.

In the above treadmill, the treadmill stand contains a frame body, and a cantilever is fixed on the lower side interior of the frame, and the cantilever is hinged to the front end. Damping cylinder is settled between chassis and treadmill stand, one side of the damping cylinder is fixed with the base frame and the other side is coupled to the treadmill stand.

In the above treadmill, elastic buffer structure was designed between running belt plate and frame: the elastic buff structure contains several buffer gadgets fixed on the two side of frame respectively and one-to-one correspondent with each. Elastic buffer structure reduces the vibration for the end of running belt, then every position in running belt could damping. Elastic buffer gadgets are fixed on the two sides of the frame respectively and one-to-one correspondent with each.

In the above treadmill, elastic buffer gadgets comprise of first strip plate and second strip plate which was setting correspondent with each other from top to bottom. First strip plate connects the side edge of running belt plate. Second strip plate is fixed on the side edge of frame. Buffer spring is installed between first and second strip plate. The buffer spring can provide upward reaction force when belt receives downward force, so as to retain the effect of vibration absorption.

Compared with the existing technology, the advantage of the low noise type direct drive style treadmill can summarize as:

1. the structure of the loop treadmill belt which set between the roller and the tubular motor is not only generate the power to tubular motor thus directly rotating loop treadmill belt as well as preventing energy loss but also it reduces the energy consumption of operational use. Meanwhile it does not require belt drive structure, reduces noise and cost simultaneously, secondly, tubular motor can also shrink the space for whole machine.

2. simple design for easy manufacture, long service life;

3. Damping effect performs good with high mechanical strength as well as provide buffing effect more multiple positions on treadmill.

Picture 1 is a schematic structural view for invention.

Picture 2 is simplified structure of treadmill.

Picture 3 is outer rotor tubular motor coupled to loop treadmill belt.

Picture 4 is schematic diagram of the explosion structure after removing the handrail.

Picture 5 is the local structure of picture 4.

Picture 6 is the suspended damping structure.

Picture 7 is the diagram of elastic buffer Target.

Picture 8 is the practical example of 2 structure.

Picture shows the following items: treadmill 1, frame 11, cantilever gallows 12, damping cylinder 13, loop treadmill belt 2, roller 3, tubular motor 4, outer rotor 41, inner stator 42, inner rotor 43, outer stator 44, tubular gadgets 45, bearing 46, running belt plate 5, suspended damping structure 6, cantilever 61, elastic expansion assembly 62, conducting rod 62*a*, elastic barrier 62*b*, chassis 7, elastic buffer 8, first strip plate 81, second strip plate 82, buffer spring 83.

SPECIFIC EMBODIMENT

The following specific embodiment of the invention including the technical solution of the present invention described with reference to the accompanying drawings, but the present invention is not limited to these embodiments.

Example 1

As it showed in picture 1-7, this kind of treadmill includes rack 1, there is a round running band 2 in the rack 1, and there is a turning roller 3 in the rack 1, in another side of the rack, there is an electrical machine in the shape of tube 4, the turning roller 3 sets in parallel with the electrical machine in the shape of tube 4, and between the turning roller 3 and the electrical machine in the shape of tube 4, there is a stable running band 5 in rack 1, the round running band 2 is disposed between the turning roller 3 and the electrical machine in the shape of tube 4, in addition, when the electrical machine in the shape of tube 4 is working, it can activate the round running band 2, and the round running band 2 is disposed in the periphery of running band 5. After the activation of electrical machine in the shape of tube 4, it can activate the round running band 2 directly.

Optimum proposal, the electrical machine in the shape of tube 4 in this example is outer rotor tubular motor which includes outer rotor 41 and inner stator 42, and then the inner stator 42 fixes in the rack 1, and the round running band 2 is around the periphery of the outer rotor 41. In the next place, the length of outer rotor 41 is more than the width of the round running band 2.

In addition, the front of the rack 1 is disposed on the bottle of the undercarriage 7 through the structure of suspension shock absorber, and when the rack 1 has the acting force from downward, it will force the rack 1 go down, the suspension shock absorber 6 can assist the rack 1 go back to the front. Specifically, the suspension shock absorber 6 in this example has two sets, and they are disposed in the two sides of the rack 1, each suspension shock absorber 6 has at least one cantilever 61, and one side of it is disposed jointly on the rack 1, the other side links with the undercarriage 7 through the elastic expansion assembly 62, the middle of the cantilever 61 links jointly on the undercarriage 7. The undercarriage 7 has handrail 71 and instrument panel 71.

Optimum proposal, the elastic expansion assembly 62 includes conducting rod 62*a*, one side of the conducting rod 62*a* links jointly with cantilever 61, and the other side goes through the undercarriage 7, and in the front of this side, there is an elastic barrier 62*b* in the undercarriage 7. The elastic expansion assembly can also be spring, with the usage of the spring, it can lessen the shock. In the next place, the cantilever 61 shows in the L-form, and in the corner of the cantilever 61 links jointly on the undercarriage 7, and the length of one side of the cantilever 61 which links with the rack 1 is more than the length of the other side of the elastic expansion assembly 62.

In addition, the running rack in this example includes frame 11, in the front of the downward of the frame 11, there is a cantilever shelving 12, the cantilever links jointly with the front of the cantilever Alvin 12, and between the above undercarriage and the middle of running rack, there is damping cylinder 13, and one side of it is disposed strongly with the undercarriage, and the other side links strongly with the running rack.

There is an elastic buffer structure between the running zone plate and the frame 11; this elastic buffer structure includes quite a few settings between the two sides of the frame 11, and it locates the elastic buffer 8 between the frame 11 and the running rack, and the elastic buffer 8 is disposed one by one. The elastic buffer structure can increase shock absorption to the backward of the running rack, and it enables every position of the running rack achieve the shock absorption. The elastic buffer 8 is disposed separately on the two sides of the frame 11, and they are disposed corresponding to each other.

The elastic buffer 8 includes the first shaped clamp 81 and the second shaped clamp 82 in the upper and downward side, the above first shaped clamp 81 links with the broadside of running rack, and the above second shaped clamp 82 is disposed steadily on the broadside of the frame 11, and between the above first shaped clamp 81 and the second shaped clamp 82, there are quite a few buffer springs 83. When the running board gains a force from the downward, the buffer springs can provide counter force in upper side, and it can obtain the effect of cushioning shock absorption.

Example 2

As it shows in picture 8, the structure in this example is the same as the example 1, while the difference is: tubular motor 4 is inner rotor tubular motor which includes inner rotor 43 and outer stator 44, the above outer stator 44 links steadily with running rack 1, in the periphery of the outer stator 44, there is tubular shape gadget 45 rotatably connected with the outer stator 44, the above tubular shape gadget 45 and the inner rotor 43 links with each other, and the inner rotor 43 can activate the tubular shape gadget 45, the above round running band 2 is around the periphery of the tubular shape gadget 45. Between the outer stator 44 and the tubular shape gadget 45, there is at least one bearing 46. Moreover, the length of the tubular shape gadget 45 is more than the twice of the length of the round running band 2.

This passage mainly describes the specific examples which is only as an example of the spirit of invention. The technicians who belong to this field of technology in this invention can amend, replenish or replace in any kinds of similar ways to the specific examples we described.

Although on the description paper, we frequently use treadmill 1, frame 11, cantilever gallows 12, damping cylinder 13, loop treadmill belt 2, roller 3, tubular motor 4, outer rotor 41, inner stator 42, inner rotor 43, outer stator 44, tubular gadgets 45, bearing 46, running belt plate 5, suspended damping structure 6, cantilever 61, elastic expansion assembly 62, conducting rod 62*a*, elastic barrier 62*b*, chassis 7, elastic buffer 8, first strip plate 81, second strip plate 82, buffer spring 83, we are not preclude the possibility of using other terms.

By using these terms is merely a convenient method for describing and interpreting the nature of the invention; it is contrary to the spirit of the invention to interpret them as any additional limitation.

The invention claimed is:

1. A low noise direct drive treadmill, comprising:
a treadmill stand;
an annular running belt disposed on the treadmill stand;
a roller fixed at a first end of the treadmill stand;
a tubular motor fixed at a second end of the treadmill stand;
a running belt plate fixed on the treadmill stand, the running belt plate being disposed between the between the roller and the tubular motor; and
a first suspension shock absorbing structure and a second suspension shock absorbing structure,
wherein the roller is disposed in parallel with the tubular motor,
when the tubular motor operates, the tubular motor directly rotates the annular running belt surrounding a periphery of the running belt plate,
wherein a front end of the treadmill stand is hung on a chassis through the first suspension shock absorbing structure,
when the treadmill stand is pulled downwards by a force so that the front end of the treadmill stand moves downwards, the first suspension shock absorbing structure is configured to move the front end of the treadmill stand upwards to restore the front end of the treadmill stand to an original position,
the first and the second suspension shock absorbing structures are symmetrically disposed on both sides of the treadmill stand,
each of the first and the second suspension shock absorbing structures includes at least a cantilever,
a first end of the cantilever is hinged with the treadmill stand,
a second end of the cantilever is connected to the chassis through an elastic expansion assembly, and
a middle of the cantilever is hinged on the chassis.

2. The treadmill according to claim 1, wherein the tubular motor is an outer-rotor type,
the tubular motor includes an outer rotor and an inner stator,
the inner stator is connected to the treadmill stand, and
the annular running belt encircles the outer rotor.

3. The treadmill according to claim 2, wherein a length of the outer rotor is no less than a width of the annular running belt.

4. The treadmill according to claim 1, wherein the tubular motor is an inner-rotor type,
the tubular motor includes an inner rotor and an outer stator,
the outer stator is connected to the treadmill stand,
a tubular-shaped part is rotatably connected to the outer stator,
the tubular-shaped part is disposed on a periphery of the outer stator,
the tubular-shaped part is connected to the inner rotor,
the inner rotor drives the tubular-shaped part to rotate, and
the annular running belt surrounds a periphery of the tubular-shaped part.

5. The treadmill according to claim 4, wherein at least one bearing is disposed between the outer stator and the tubular-shaped part.

6. The treadmill according to claim 4, wherein a length of the tubular-shaped part is less than a width of the annular running belt.

7. The treadmill according to claim 1, wherein the elastic expansion assembly includes a conductive rod, a first end of the conductive rod is hinged to the cantilever, a second end of the conductive rod passes through the chassis, and an elastic block against the chassis is fixed at the second end of the conducting rod.

8. The treadmill according to claim 7, wherein the cantilever is L-shaped having a first part and a second part, a corner part of the cantilever is hinged on the chassis, a length of the first part of the cantilever connected to the treadmill stand is larger than a length of the second part of the cantilever connected to the elastic expansion assembly.

9. A low noise direct drive treadmill, comprising:

a treadmill stand;

an annular running belt disposed on the treadmill stand;

a roller fixed at a first end of the treadmill stand;

a tubular motor fixed at a second end of the treadmill stand;

a running belt plate fixed on the treadmill stand, the running belt plate being disposed between the between the roller and the tubular motor, wherein the roller is disposed in parallel with the tubular motor, when the tubular motor operates, the tubular motor directly rotates the annular running belt surrounding a periphery of the running belt plate, wherein a front end of the treadmill stand is hung on a chassis through a suspension shock absorbing structure, when the treadmill stand is pulled downwards by a force so that the front end of the treadmill stand moves downwards, the suspension shock absorbing structure is configured to move the front end of the treadmill stand upwards to restore the front end of the treadmill stand to an original position, wherein the treadmill stand includes a frame, the suspension shock absorbing structure includes at least a cantilever, a cantilever shelving is fixed below a front portion of the frame, the cantilever is hinged on a front end of the cantilever shelving, a damping cylinder is disposed between the chassis and a middle of the treadmill stand, a first end of the damping cylinder is connected to the chassis, and a second end of the damping cylinder is connected to the treadmill stand.

10. The treadmill according to claim 9, further comprising:

an elastic buffer structure, wherein the elastic buffer structure is disposed between the running belt plate and the frame, the elastic buffer structure includes elastic buffer parts, the elastic buffer parts are symmetrically disposed on both sides of the frame, and the elastic buffer parts are disposed between the frame and the running belt plate.

11. The treadmill according to claim 10, wherein each of the elastic buffer parts includes a first shaped clamp, a second shaped clamp, and buffer springs sandwiched between the first shaped clamp and the second shaped clamp, the first shaped clamp is connected to a broadside of the running belt plate, the second shaped clamp is fixed on a broadside of the frame, and when a force pushes the running plate downwards, the buffer springs are configured to provide an upward counter force.

* * * * *